US006401360B1

(12) United States Patent
Piccinino, Jr. et al.

(10) Patent No.: US 6,401,360 B1
(45) Date of Patent: Jun. 11, 2002

(54) APPARATUS AND METHOD FOR DRYING PHOTOSENSITIVE MATERIAL USING A RADIANT HEAT ASSEMBLY

(75) Inventors: Ralph L. Piccinino, Jr., Ruxh; Kevin H. Blakely, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/548,442

(22) Filed: Apr. 13, 2000

(51) Int. Cl.[7] ..... F26B 7/00

(52) U.S. Cl. ..... 34/420; 34/421; 34/273; 34/68

(58) Field of Search ..... 34/420, 421, 423, 34/273, 637, 643, 68, 418

(56) References Cited

U.S. PATENT DOCUMENTS 1,802,407 A * 4/1931 Danninger et al. ..... 34/273
3,720,002 A 3/1973 Martin
3,973,328 A 8/1976 Theobald
4,142,301 A 3/1979 Goodall
4,257,172 A 3/1981 Townsend
4,315,136 A 2/1982 Block et al.
4,485,565 A 12/1984 Ertl et al.
5,097,605 A 3/1992 Kashino et al.
5,228,210 A 7/1993 Hofmuth et al.
5,369,894 A * 12/1994 Schaffer et al. ..... 34/273
5,739,896 A * 4/1998 Patton et al. ..... 355/27
6,092,303 A * 7/2000 Piccinino, Jr. et al. ..... 34/421

* cited by examiner

*Primary Examiner*—Jiping Lu
(74) *Attorney, Agent, or Firm*—Frank Pincelli

(57) ABSTRACT

A drying apparatus and method utilizes the combination of radiant heat and air to quickly dry photosensitive material. The arrangement of the drying apparatus is such that radiant heat said assembly including a heating bar and a reflective cover positioned on one side of said conveying path, and a reflective member disposed on the other side of said conveying path, said reflective cover and said reflective member reflecting the heat from said heating bar toward said conveying path.

23 Claims, 3 Drawing Sheets

APPARATUS AND METHOD FOR DRYING PHOTOSENSITIVE MATERIAL USING A RADIANT HEAT ASSEMBLY

FIELD OF THE INVENTION

The present invention relates to the field of photoprocessing, and more particularly, to an apparatus and method for drying photosensitive material.

BACKGROUND OF THE INVENTION

When drying photosensitive material such as processed photosensitive material, photographic prints, cut sheets or film, the photosensitive material is traditionally conveyed through a dryer by way of guides and/or rollers which contact the photosensitive material. During drying of the photosensitive material it is beneficial that the drying takes place in a rapid manner and that any contact on an emulsion side of the photosensitive material be minimized. By minimizing contact between the emulsion side of the photosensitive material and the guides and/or rollers, distortions or damage to the photosensitive material is decreased.

U.S. Pat. No. 3,973,328 discloses the use of radiant heat and forced air during the drying of photographic sheets. In this document the air flow is a cool air flow which is maintained between 20° C. and 40° C. and assists in cooling down rollers located on each side of a radiant heating bar arrangement.

U.S. Pat. No. 4,257,172 discloses a combined forced air and infrared dryer. The dryer of the U.S. Pat. No. 4,257,172 is primarily for removing vaporous substances such as paints, adhesives, and moisture from a product. Therefore, in U.S. Pat. No. 4,257,172, the product is first introduced by way of a conveyor belt below ventilating nozzles which provide gases onto the product to remove moisture and other vaporous substances from the product. Thereafter, the product is conveyed below an array of heaters which also include ventilating passages to remove a vapor barrier.

In U.S. issued Pat. No. 6,092,303 issued Jul. 25, 2001 and U.S. Pat. No. 6,058,621 issued May 9, 2000 there is disclosed the use of radiant heat dryers on both sides of a photosensitive media. This arrangement while effective takes up greater space and use substantial amounts of heat.

SUMMARY OF THE INVENTION

The foregoing and other objects, features and advantages of the invention will be apparent from the following more particular description of the preferred embodiment of the invention illustrated in the accompanying drawings.

The present invention is directed to a novel apparatus and method for drying a photosensitive material in which the photosensitive material. In accordance with one aspect of the present invention there is provided an apparatus for drying photosensitive material, the apparatus comprising:

radiant heating bar assembly for applying radiant heat to photosensitive material passing along a conveying path so as to substantially dry the photosensitive material, the assembly including a heating bar and a reflective cover positioned on one side of the conveying path, and a reflective member disposed on the other side of the conveying path, the reflective cover and the reflective member reflecting the heat from the heating bar toward the conveying path.

In accordance with another aspect of the present invention there is provided a method of drying photosensitive material, the method comprising the steps of:

applying radiant heat to a photosensitive material at a radiant heat application assembly to substantially dry the photosensitive material, the assembly including a heating bar and a reflective cover positioned on one side of the conveying path, and a reflective member disposed on the other side of the conveying path, the reflective cover and the reflective member reflecting the heat from the heating bar toward the conveying path.

In accordance with yet another aspect of the present invention there is provided a photoprocessing system comprising:

a processing assembly for processing photosensitive material along a conveying path; and a drying assembly for drying the processed photosensitive material including a heating bar and a reflective cover positioned on one side of the conveying path, and a reflective member disposed on the other side of the conveying path, the reflective cover and the reflective member reflecting the heat from the heating bar toward the conveying.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
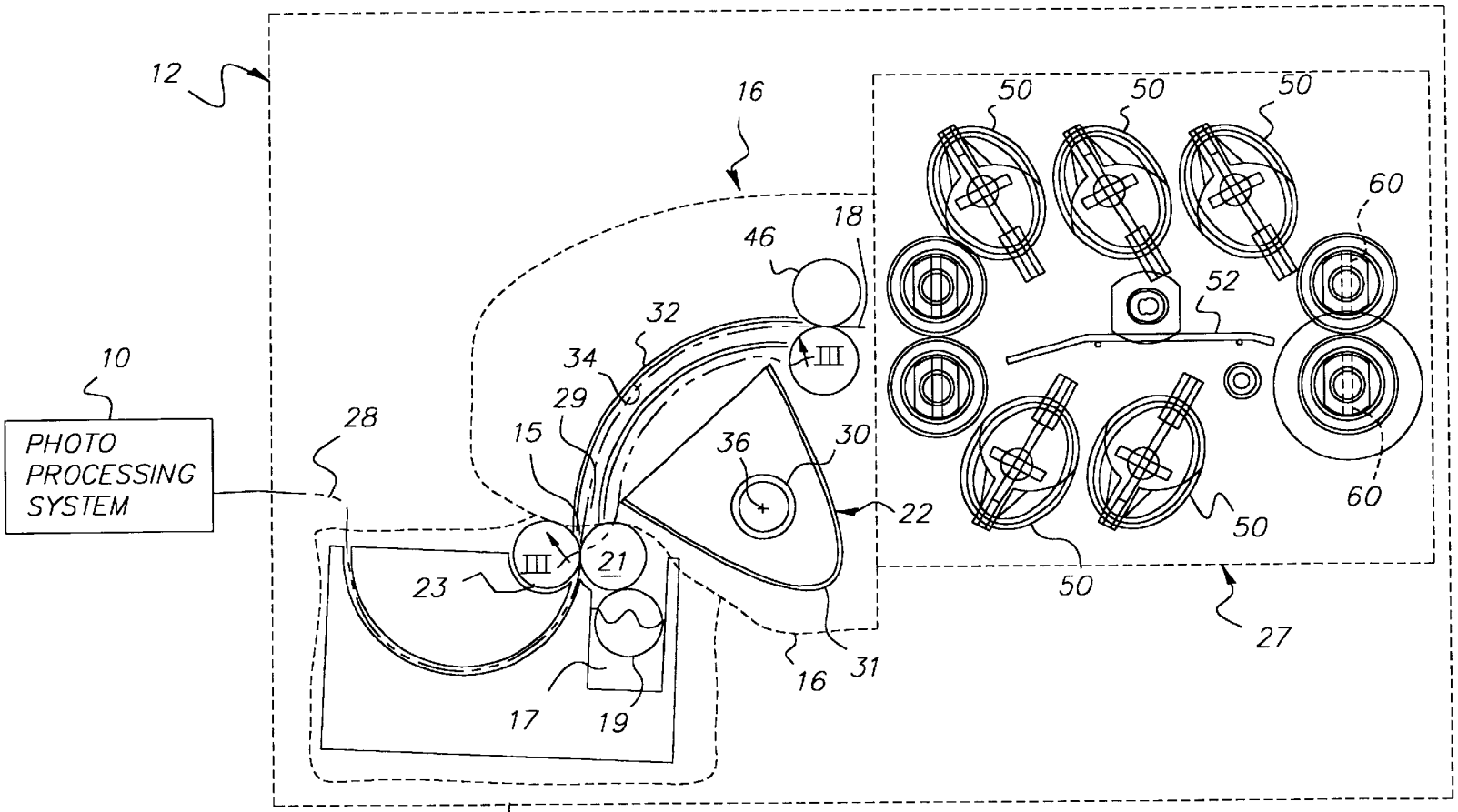
FIG. 1 is a schematic illustration of a photoprocessing system in accordance with the present invention, including the drying apparatus of the present invention.

Referring now to the drawings, wherein like reference numerals represent identical or corresponding parts throughout the illustrated Figures, FIG. 1 schematically illustrates a photoprocessing system 10 as well as a combined coating and drying apparatus 12 of the present invention. The coating and drying apparatus 12 comprises a coating assembly 14 and a drying assembly 16.

As illustrated in FIG. 1, coating drying assembly 12 can receive photosensitive material 28 which exits a processing assembly 10 by way of conveying path 18. Processing assembly 10 can be part of a processing section and can be a known assembly which includes a series of processing tanks. Each of the processing tanks can include, for example, developer solution, fixing solution, bleaching solution, washing solution, etc. Each processing tank represents a different step in the processing of photosensitive material 28. As an option, the coating assembly 14 may be a separate device placed up stream of the dryer assembly in conveying path 18 and a bypass line may be provided for selective coating of processed photosensitive material 28 leaving processing assembly 10.

For example, in one embodiment, processed photosensitive material 28 exiting processing assembly 10 can directly enter drying assembly 16 of the present invention. As a further embodiment, coating apparatus 14 can be a separate device positioned in conveying path 18 so as to apply a solution of predetermined viscosity onto the processed photosensitive material 28 prior to entering drying assembly 16.

With respect to coating assembly 14, this could be any type of coating apparatus which provides a solution onto the processed photosensitive material 28. For example, coating assembly 14 could be an apparatus which provides a solution of predetermined viscosity onto the processed photosensitive material 28 such as disclosed in U.S. issued Pat. Nos. 5,984,539; 5,905,924 and 5,875,370. In the particular embodiment illustrated assembly 14 includes a processing path 15, a reservoir 17 in which a coating solution is supplied. A donor roller 19 is partially submerged within the processing solution in reservoir 17 which provides solution to a metering roller 21 which metes out a metered amount of solution on to the emulsion side of the photosensitive material 28 passing there through.

As explained above, the drying assembly 16 is beneficial in drying photosensitive material 28 which has been coated with solution since drying assembly 16 is effective to quickly dry the photosensitive material 28 without disturbing the emulsion side and/or coating applied on the photosensitive material 28. This is just an example for utilizing drying assembly 16 of the present invention, and it is recognized that drying assembly 16 is not limited to drying photosensitive material 28 having a solution applied thereon, and it also not limited to being utilized downstream of a coating apparatus or a processing assembly. Drying assembly 16 can be used as part of an existing processing system, can be built into a processing system, can be added on as a accessory or can be used as a stand alone unit. Also, drying assembly 16 is applicable to dry any type of photosensitive material 28, photographic print, cut web or sheet, or any type of paper product in which drying is desired while minimizing distortions. Drying assembly 16 can also be positioned at various locations of a processing system where drying is desired.

Figure 3:
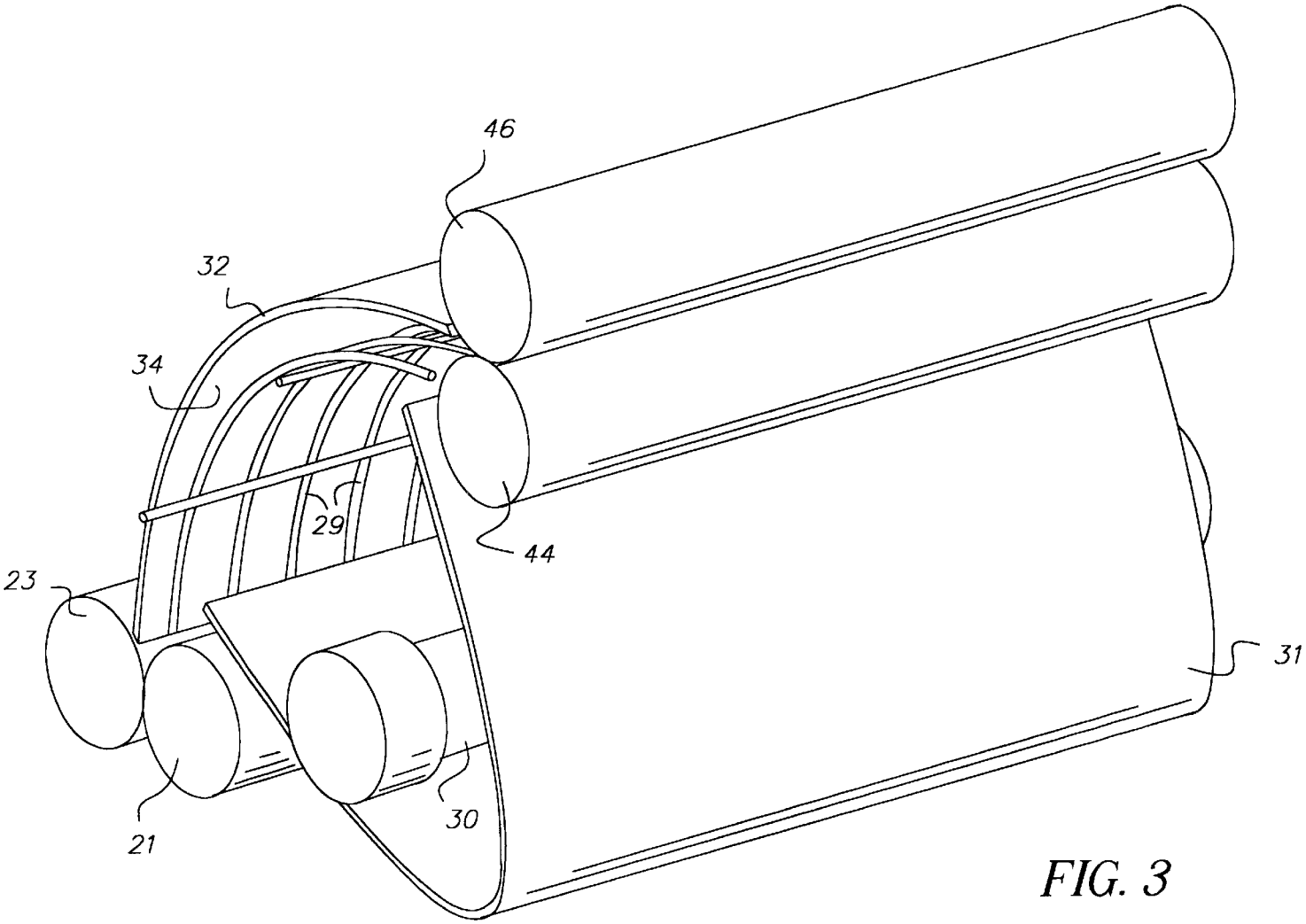
FIG. 3 is a perspective view of the heating section of the system of FIG. 1 illustrating the media guides and curved heat reflective surface.

As illustrated in FIG. 1, drying assembly 16 includes a radiant heat assembly 22 located in a vicinity of exit of coating assembly 14 and an air flow application assembly 27 located downstream of radiant heat assembly 22 with respect to a conveying path 18 of the photosensitive material 28. Radiant heat assembly 22 of dryer 16 includes radiant heating bar 30 located on one side of photosensitive material 28 conveying path 18, which extend transversely with respect to conveying path 18. Heat assembly 22 includes a reflective cover 31 which is preferably parabolic in shape and is effective to direct radiant heat in a direction toward photosensitive material 28 conveying path 18. A curved reflective member 32 is disposed opposite the heating bar 30 on the other side of the conveying path 18. This causes the path 18 in this region to be curved so as to lengthen the actual path the photosensitive material is subjected to the heating bar 30. The cured shape, which preferably provides a substantially constant distance from the heating bar, provides a substantially uniform heating along the heating path adjacent the heating bar. A plurality of spaced wire guides 29 (see FIG. 3) spaced from surface 34 are provided to retain the photosensitive material 28 along path 18 therebetween. Member 32 has surface 34 which forms a portion of the conveying path 18. Preferably, as illustrated the surface 34 has configuration such that it has a substantial constant radius of curvature R for a majority of the conveying path 18 which it forms, with the heating bar 30 being the center of radius 36 for the curved surface 34. This provides a substantially constant heat application on the photosensitive material 28 from when it first feels the affect of the heating bar until it is no longer affected by the heating bar. The surface 34 is also preferably a reflective surface so that it radiates back the heat from heating bar 30 toward the photosensitive material 28. In the particular embodiment illustrated the surface 34 is made of any suitable reflective material. The reflecting of the heat by surface 34 from bar 30 assists in shortening the drying time of the photosensitive material 28, especially on the back side. In the embodiment illustrated the surface 34 is made of stainless steel. Thus, the photosensitive material 28 is subjected to radiant heat from both sides. This specific arrangement is effective to minimize any distortion to an emulsion side of the photosensitive material 28, and is especially effective in the event the photosensitive material 28 includes an applied coating, since it will quickly dry the coating as well as the underlying photosensitive material 28 without any touching or distortion.

Drive rollers 21, 23 located in coating assembly 14 adjacent the entrance of the radiant dryer assembly 16 drive the photosensitive material 28 into radiant dryer assembly 16. Guide drive rollers 44, 46 conveys the photosensitive material 28 from dryer assembly 16 into air flow application assembly 27. Air flow application assembly 27 includes a plurality of air nozzles 50 positioned on opposite sides of a photosensitive material 28 guide member 52. Air nozzles 50 supply heated air, which has been heated in a known manner, onto both sides of photosensitive material 28 as it passes through guide member 52. This permits a final drying of the photosensitive material 28 and if applicable a coating solution applied to the surface of the photosensitive material 28.

Therefore, with the arrangement of the present invention, the photosensitive material 28 is first subjected to radiant heat in radiant heat assembly 16 by the way of heating bar 30 and reflective member 32 so as to achieve a substantial drying of the photosensitive material 28 without distorting the surface of the photosensitive material 28. This is especially effective in situations in which the photosensitive material 28 has a coating solution applied thereon. The reflective member assists in providing efficient and uniform drying. After the photosensitive material 28 exits radiant heat assembly 16 it is conveyed to air flow application assembly 27, where a heated air flow is applied on both sides by way of air flow nozzles 50; since the photosensitive material 28 has already been subjected to radiant heat in radiant assembly 16, air flow nozzles 50 provide for a final drying of the photosensitive material 28 without distorting the photosensitive material 28 and without emulsion side contact. Additionally, with the specific arrangement of the present invention, a rapid drying can be achieved through the use of a compact unit.

Figure 2:
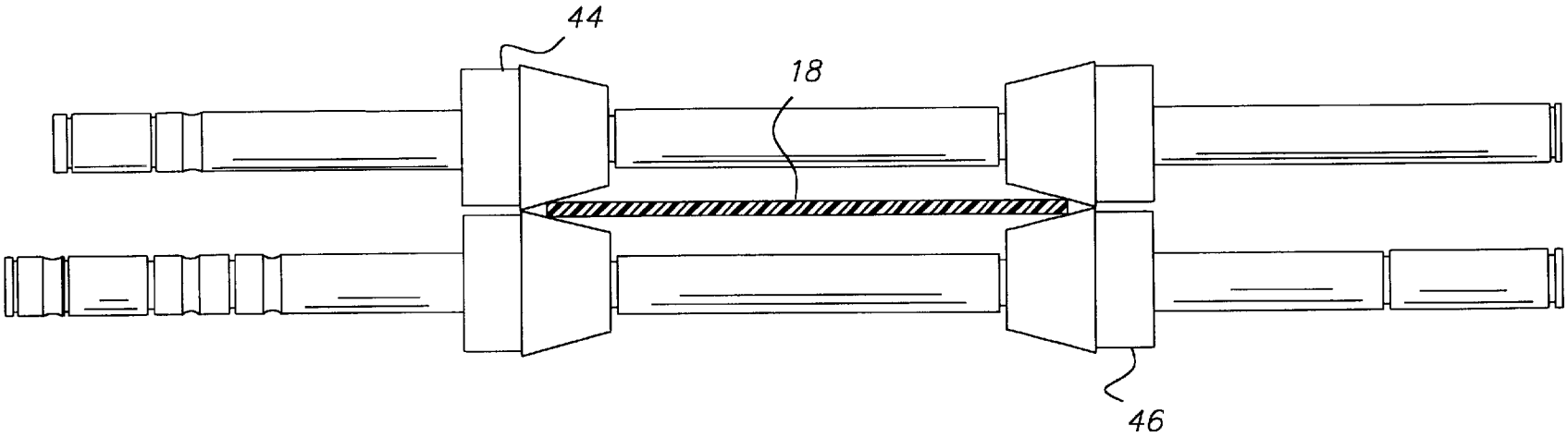
FIG. 2 is a representative example of drive roller pair which can be utilized within the drying apparatus of the present invention.

As further shown in FIG. 1, drive roller pair 44, 46 conveys the photosensitive material 28 from radiant heat assembly 16 a to air flow application assembly 27. In situations where the photosensitive material 28 being dried is a photosensitive material 28 having a coating solution applied thereon, drive roller pair 60 could be an approximately V-shaped roller pair as illustrated in FIG. 2. This type of drive roller pair arrangement permits the conveyance of photosensitive material 28, as shown in FIG. 2, while only touching the side edges of photosensitive material 28. This is especially effective when drying photosensitive material 28 having a coating solution applied thereon and adds to the efficiency of drying assembly 16 of the present invention.

With the arrangement of the of the present invention, the photosensitive material 28 will (1) be subject to radiant heat without emulsion side contact (2) be conveyed by drive roller pair 44, 46 as illustrated in FIG. 2 which does not touch the emulsion side of photosensitive material 28; and (3) thereafter transferred to air flow application assembly 27, where heated air is applied on both sides. The heated air is preferably in the range of approximately 150–200° F. which can be heated in a conventional way and supplied to dryer apparatus by way of a known air blower and duct arrangement (not shown).

It is noted that the configuration of drive roller pair 44, 46 is not limited to the approximately V-shape shown, and can be other shapes depending on the type of material 28 which is to be dried. For example, drive roller pair 44, 46 could be conventional rollers which have a non-stick surface such as a teflon surface. This type of arrangement can be applied in situations where some degree of emulsion side contact can be tolerated.

As further illustrated in FIG. 1, each of air flow nozzles 50 are oriented at an angle with respect to a line which is perpendicular to conveying path 18. More specifically, each of air flow nozzles 50 are oriented so as to direct air flow away from radiant heat application assembly 27 and thereby away from heating bar 30. With this type of arrangement, the air flow from nozzles 50 will not be directed toward a vicinity of heating bar 30 and thereby will not achieve an unwanted cooling of heating bar 30.

Therefore, the present invention provides for a compact efficient drying apparatus which can be placed downstream of a processing assembly as an added-on accessory, can be built into an existing processor or is functional as a stand-alone unit. Drying apparatus further pen-nits a quick and efficient drying of both sides of a photosensitive material 28 without emulsion side contact and can dry a web of photosensitive material 28 or cut sheets.

The invention has been described in detail with particular reference to certain preferred embodiments thereof, but it will be understood that variations and modifications can be effected within the scope of the present invention.

PARTS LIST

10. photoprocessing system
12. coating drying assembly
14. coating assembly
15. processing path
16. drying assembly
17. reservoir
18. conveying path
19. donor roller
21. drive roller
22. heat assembly
23. driver roller
27. air flow application assembly
28. photosensitive material
29. wire guides
30. radiant heating bar
31. reflective cover
32. reflective member
34. surface
36. heat radius
44. guide drive roller
46. guide drive roller
50. air flow nozzles
52. guide member
60. driver roller pair

What is claimed is:

1. An apparatus for drying photosensitive material, the apparatus comprising:

a radiant heating bar assembly for applying radiant heat to photosensitive material passing along a curved conveying path so as to substantially dry the photosensitive material, said assembly including a heating bar and a curved reflective cover positioned on one side of said curved conveying path, and a curved reflective member disposed on the other side of said curved conveying path, said curved reflective cover and said curved reflective member reflecting the heat from said heating bar toward said curved conveying path.

2. An apparatus according to claim 1 wherein said curved reflective member has a curved surface, said curved surface having a radius of curvature having a center of radius located at said heating bar.

3. An apparatus according to claim 1 wherein said curved reflective member has reflective surface having a configuration such that a substantially uniform heat is reflected on to said photosensitive material along said curved conveying path.

4. An apparatus according to claim 1 further comprising at least one air flow nozzle directing an air flow onto said photosensitive material so as to provide for a final drying of the photosensitive material.

5. An apparatus according to claim 4, wherein said air flow is a heated air flow.

6. An apparatus according to claim 4, wherein said at least one air flow nozzle is oriented so as to direct said air flow in a direction away from said radiant heating bar arrangement.

7. An apparatus according to claim 1, further comprising:

a first drive roller pair located at a photosensitive material curved conveying path and between said radiant heating bar arrangement and said at least one air flow nozzle; and a second drive roller pair located at said photosensitive material curved conveying path and between an exit of said apparatus and said at least one air flow nozzle.

8. An apparatus according to claim 7, wherein said first drive roller pair comprises approximately V-shaped rollers and said second drive roller pair comprises segmented rollers.

9. An apparatus according to claim 1 further comprising a guide member spaced from said reflective member for maintaining said photosensitive material along the curved conveying path.

10. An apparatus according to claim 9 wherein said guide member comprises a plurality of spaced curved wire guides.

11. A photoprocessing system comprising:

a processing assembly for processing photosensitive material along a curved conveying path; and a drying assembly for drying said processed photosensitive material including a heating bar and a curved reflective cover positioned on one side of said curved conveying path, and a curved reflective member disposed on the other side of said curved conveying path, said curved reflective cover and said curved reflective member reflecting the heat from said heating bar toward said conveying.

12. An apparatus according to claim 11 wherein said curved reflective member has a curved surface, said curved surface having a radius of curvature having a center of radius located at said heating bar.

13. An apparatus according to claim 11 wherein said curved reflective member has reflective surface having a configuration such that a substantially uniform heat is reflected on to said photosensitive material along said curved conveying path.

14. An apparatus according to claim 11 further comprising at least one air flow nozzle directing an air flow onto said photosensitive material so as to provide for a final drying of the photosensitive material.

15. An apparatus according to claim 14, wherein said air flow is a heated air flow.

16. An apparatus according to claim 15, wherein said at least one air flow nozzle is oriented so as to direct said air flow in a direction away from said radiant heating bar arrangement.

17. An apparatus according to claim 11, further comprising:

a first drive roller pair located at a photosensitive material curved conveying path and between said radiant heating bar arrangement and said at least one air flow nozzle; and a second drive roller pair located at said photosensitive material curved conveying path and between an exit of said apparatus and said at least one air flow nozzle.

18. An apparatus according to claim 17, wherein said first drive roller pair comprises approximately V-shaped rollers and said second drive roller pair comprises segmented rollers.

19. An apparatus according to claim 11 further comprising a guide member spaced from said curved reflective member for maintaining said photosensitive material along the curved conveying path.

20. An apparatus according to claim 11 wherein said guide member comprises a plurality of spaced curved wire guides.

21. A method of drying photosensitive material, the method comprising the steps of:

applying radiant heat to a photosensitive material at a radiant heat application assembly to substantially dry the photosensitive material along a curved conveying path, said assembly including a heating bar and a curved reflective cover positioned on one side of said curved conveying path, and a curved reflective member disposed on the other side of said curved conveying path, said curved reflective cover and said curved reflective member reflecting the heat from said heating bar toward said curved conveying path.

22. A method according to claim 21 wherein said applying radiant heat comprises providing a substantially uniform radiant heat to the photosensitive material as it passes by said heating bar.

23. A method according to claim 21, wherein said applying radiant heat comprises providing a substantially uniform radiant heat to both side of said photosensitive material.

* * * * *